US008585381B2

(12) United States Patent
Kiyokawa et al.

(10) Patent No.: US 8,585,381 B2
(45) **Date of Patent: *Nov. 19, 2013**

(54) SCROLL TYPE COMPRESSOR HAVING AN INTERCOMMUNICATION PATH IN WHICH A PIN MEMBER IS INSERTED

(75) Inventors: Yasunori Kiyokawa, Ora-gun (JP); Yoshiaki Koike, Ota (JP); Tsutomu Kon, Ora-gun (JP); Katsuki Akuzawa, Ora-gun (JP); Satoshi Iitsuka, Ota (JP); Kenji Aida, Ota (JP); Akihiro Hayashi, Ora-gun (JP); Kazuyoshi Sugimoto, Ora-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 312 days.

This patent is subject to a terminal disclaimer.

(21) Appl. No.: 12/709,100

(22) Filed: Feb. 19, 2010

(65) Prior Publication Data

US 2010/0215535 A1 Aug. 26, 2010

(30) Foreign Application Priority Data

Feb. 20, 2009 (JP) ..... 2009-037444

(51) Int. Cl.
*F03C 2/00* (2006.01)
*F04C 2/00* (2006.01)
*F04C 18/00* (2006.01)

(52) U.S. Cl.
USPC ..... 418/55.5; 418/55.1; 418/55.6; 418/57; 418/270

(58) Field of Classification Search
USPC ..... 418/55.1–55.6, 57, 270, DIG. 1
See application file for complete search history.

(56) References Cited

U.S. PATENT DOCUMENTS 4,518,324 A 5/1985 Mizuno et al.
4,702,683 A 10/1987 Inaba et al.
5,249,941 A 10/1993 Shibamoto
5,511,831 A 4/1996 Barton (Continued)

FOREIGN PATENT DOCUMENTS

JP 50073025 U * 6/1975 ..... F16K 1/40
JP H1-163484 6/1989

(Continued)

OTHER PUBLICATIONS

US Office Action issued in U.S. Appl. No. 12/709,051 issued Mar. 26, 2012.

(Continued)

*Primary Examiner* — Theresa Trieu
(74) *Attorney, Agent, or Firm* — McDermott Will & Emery LLP

(57) ABSTRACT

A scroll type compressor including a fixed scroll, a movable scroll engaged with the fixed scroll, and a hermetically sealed container in which the fixed scroll and the movable scroll are mounted. The fixed scroll or the movable scroll has an intercommunication path for lubricating oil that is opened to the outside of the one scroll at one end thereof, extends radially inside the scroll and has a high-pressure opening intercommunicating with a high-pressure portion of the container and a low-pressure opening intercommunicating with a low-pressure portion in the scroll, a pin member disposed in the intercommunication path so as to be movable radially in the scroll, a screw member closing one end of the intercommunication path, and a stopper provided at a predetermined position in the intercommunication path to regulate radial movement of the pin member.

4 Claims, 5 Drawing Sheets

(56) References Cited

U.S. PATENT DOCUMENTS

| | | | | |
|---|---|---|---|---|
| 6,186,556 | B1 | 2/2001 | Masuyama et al. | |
| 6,203,299 | B1 * | 3/2001 | Williams et al. | 418/55.5 |
| 6,761,545 | B1 * | 7/2004 | Witham et al. | 418/55.5 |
| 6,827,563 | B2 * | 12/2004 | Hiwata et al. | 418/55.5 |
| 7,134,853 | B2 * | 11/2006 | Yamaji et al. | 418/55.5 |
| 2007/0145739 | A1 | 6/2007 | Haberl | |

FOREIGN PATENT DOCUMENTS

| | | | | | |
|---|---|---|---|---|---|
| JP | 2001-304130 | A | | 10/2001 | |
| JP | 2002168183 | A | * | 6/2002 | F04C 18/02 |
| JP | 2003-239880 | A | | 8/2003 | |
| JP | 2004-060532 | | | 2/2004 | |
| JP | 2004-225583 | A | | 8/2004 | |
| JP | 2005-240774 | | | 9/2005 | |

OTHER PUBLICATIONS

United States Office Action issued in U.S. Appl. No. 12/709,071 dated Jul. 30, 2012.

Japanese Office Action, and English translation thereof, issued in Japanese Patent Application No. 2009-037445 dated Jan. 22, 2013.

Japanese Office Action, and English translation thereof, issued in Japanese Patent Application No. 2009-037444 dated Jan. 22, 2013.

United States Advisory Action issued in U.S. Appl. No. 12/709,071 mailed Oct. 1, 2012.

Office Action issued in corresponding U.S. Appl. No. 12/709,071, dated Jun. 7, 2013.

Notice of Allowance issued in corresponding U.S. Appl. No. 12/709,071, dated Aug. 29, 2013.

* cited by examiner

SCROLL TYPE COMPRESSOR HAVING AN INTERCOMMUNICATION PATH IN WHICH A PIN MEMBER IS INSERTED

INCORPORATION BY REFERENCE

The present application claims priority under 35 U.S.C. §119 to Japanese Patent Application No. 2009-037444 filed on Feb. 20, 2009. The content of the application is incorporated herein by reference in its entirety.

BACKGROUND OF THE INVENTION

1. Field of the Invention

The present invention relates to a scroll type compressor having an oil path through which lubricating oil is supplied to engagement portions at a low-pressure side between a fixed scroll and a movable scroll.

2. Description of the Related Art

There is known a scroll type compressor in which a fixed scroll and a movable scroll engaged with the fixed scroll are accommodated in a hermetically sealed container. In this type of scroll compressors, there has been proposed a scroll type compressor which has an oil path for supplying lubricating oil to an engagement portion at the low-pressure side between the fixed scroll and the movable scroll, and a flow rate restricting member which has a main body having a spiral passage formed on the outer periphery thereof and is disposed in the oil path (see JP-A-2004-60532, for example).

In the construction disclosed in the above publication, the restriction of the flow rate is dependent on the size of the spiral passage formed on the outer periphery of the main body, and thus the processing precision (machining performance) of the spiral passage has been required to be high, so that it has been difficult to process the spiral passage.

SUMMARY OF THE INVENTION

Therefore, an object of the present invention is to provide a scroll type compressor that can restrict the flow rate of lubricating oil without requiring a high processing precision and can be manufactured in low cost.

In order to attain the above object, there is provided a scroll type compressor comprising a fixed scroll; a movable scroll engaged with the fixed scroll and a hermetically sealed container in which the fixed scroll and the movable scroll are mounted. One scroll of the fixed scroll and the movable scroll is provided with an intercommunication path that is opened to the outside of the one scroll at one end thereof, extends substantially in a radial direction of the one scroll and has a high-pressure opening intercommunicating with a high-pressure portion of the hermetically sealed container and a low-pressure opening intercommunicating with a low-pressure portion in the one scroll, oil being supplied from the high-pressure opening through the inside of the intercommunication path to the low-pressure opening, a pin member that is configured to be slightly smaller in diameter than the intercommunication path and disposed in the intercommunication path so as to be movable in the radial direction of the one scroll by a predetermined distance, a screw member that is provided at one end of the intercommunication path so as to close the one end and is disposed so as to be spaced from the pin member at a predetermined interval, and a stopper that is provided at a predetermined position in the intercommunication path and regulates movement of the pin member in the radial direction so that the pin member is radially movable between the screw member and the stopper.

According to the present invention, the intercommunication path is formed in any one of the movable scroll and the fixed scroll, and the pin member is inserted into this intercommunication path. Therefore, the flow rate of lubricating oil supplied from the high pressure side to the low pressure side can be restricted (regulated) by the gap between the outer periphery of the pin member and the inner periphery of the intercommunication path and the gap between the outer periphery of the pin member and the low-pressure opening opened to the low pressure portion in the movable or fixed scroll.

The pin member is freely movable in the radial direction by the distance corresponding to the predetermined interval. In this construction, as compared with a case where the pin member is fixed in the radial direction, the size of the gap between the outer periphery of the pin member and the inner periphery of the intercommunication path and the size of the gap between the outer periphery of the pin member and the low pressure opening opened to the low pressure portion of the scroll are more excellently adjusted by the movement of the pin member.

According to this construction, it is unnecessary to process the pin member, and when the original shape of the pin member is cylindrical, the pin member can be directly used without modifying the shape. Therefore, it is not dependent on the processing precision, and also the manufacturing cost of the pin member can be reduced.

In this case, the pin member may be designed to be sucked to the low-pressure opening opened to the low pressure portion in the scroll due to the pressure difference between the high pressure portion and the low pressure portion, so that the pore space of the low-pressure opening is restricted (regulated).

According to this construction, by defining the size of the low-pressure opening, the size of the gap between the outer periphery of the pin member and the low-pressure opening opened to the low pressure portion in the scroll can be adjusted. Therefore, the size of the gap can be managed with high precision.

Furthermore, the intercommunication path may have a linearly extending portion in the movable scroll. Still furthermore, the intercommunication path may have a first path opened to the outside of the one scroll at one end thereof, and a second path that is formed by subjecting the first path to reaming processing until a predetermined depth position of the first path so that a step portion serving as the stopper is formed between the first path and the second path, the pin member being inserted in the second path.

According to this construction, the first path (lower hole) of the intercommunication path is first formed so as to be opened to the outside of the scroll at one end thereof, and then the first path is subjected to reaming processing from the one end thereof to a predetermined depth position of the first hole, thereby forming the second path (insertion hole) in which the pin member is inserted. In this case, the step portion is formed at the boundary between the first path and the second path, and this step portion serves as the stopper. Accordingly, the stopper can be simply formed.

Furthermore, the reaming processing is conducted from the one end of the first path till the predetermined depth position of the first path, and thus the finishing precision of the inner peripheral surface of the second path (insertion hole) is enhanced, and the size of the gap between the outer periphery of the pin member and the inner periphery of the intercommunication path and the size of the gap between the outer periphery of the pin member and the low-pressure opening opened to the low pressure portion in the scroll can be managed with high precision.

According to the present invention, the pin member is inserted in any one of the fixed scroll and the movable scroll. Therefore, the flow amount of lubricating oil flowing from the high pressure side to the low pressure side can be properly restricted (regulated) by the gap between the outer periphery of the pin member and the inner periphery of the intercommunication path and the gap between the outer periphery of the pin member and the low-pressure opening opened to the low pressure portion in the scroll.

BRIEF DESCRIPTION OF THE DRAWINGS

FIGS. 5A and 5B are diagrams showing another embodiment, wherein FIG. 5A is a cross-sectional view, and FIG. 5B is an enlarged view of a main part.

DETAILED DESCRIPTION OF THE PREFERRED EMBODIMENT

A preferred embodiment according to the present invention will be described hereunder with reference to the accompanying drawings.

Figure 1:
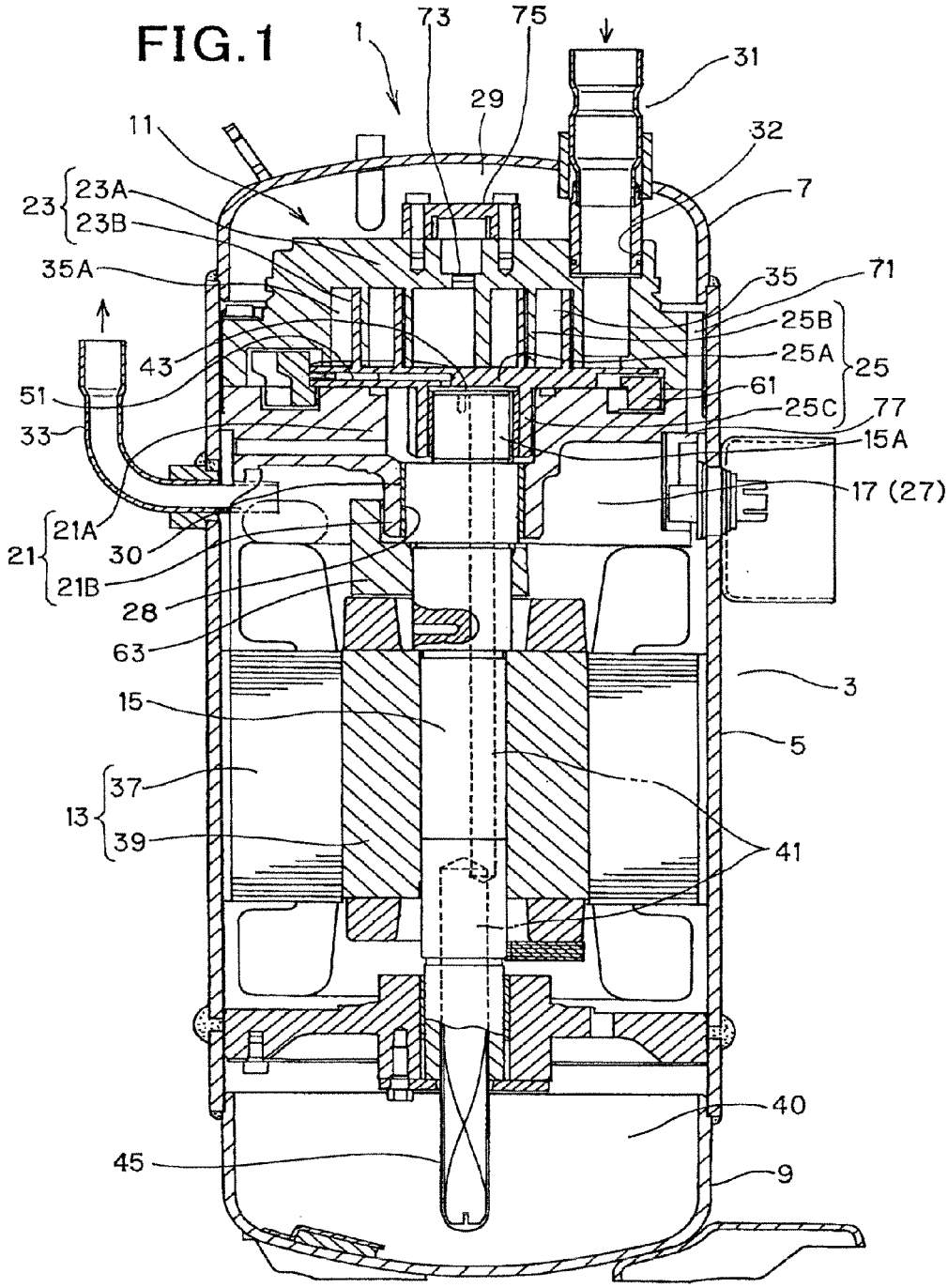
FIG. 1 is a cross-sectional view showing an embodiment of the present invention.

In FIG. 1, reference numeral 1 represents a scroll type compressor having a high internal pressure. The compressor 1 is connected to a refrigerant circuit (not shown) in which refrigerant is circulated to perform a refrigeration cycle operation, and compresses the refrigerant. The compressor 1 has a hermetically-sealed dome type casing 3 which is designed in an elongated cylindrical shape.

The casing 3 is constructed as a pressure container by a casing main body 5 as a cylindrical body portion having an axis line in the up-and-down direction, a saucer-shaped upper cap 7 which is air-tightly welded and integrally joined to the upper end portion of the casing main body 5 and has an upwardly projecting convex surface, and a saucer-shaped lower cap 9 having a downwardly projecting convex surface, and the inside of the casing 3 is designed to have a cavity.

A scroll compression mechanism 11 for compressing refrigerant, and a driving motor 13 disposed below the scroll compression mechanism 11 are mounted in the casing 3. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

The scroll compression mechanism 11 has a housing 21 as a substantially cylindrical accommodating member which is opened at the upper side thereof and has a bottom, a fixed scroll 23 which is disposed in close contact with the upper surface of the housing 21, and a movable scroll 25 which is disposed between the fixed scroll 23 and the housing 21 and engaged with the fixed scroll 23. The housing 21 is press-fitted in the casing main body 5 over the whole outer peripheral surface thereof in the peripheral direction. The inside of the casing 3 is compartment into a high pressure space 27 at the lower side of the housing 21 and a discharge space 29 at the upper side of the housing 21, and the respective spaces 27 and 29 intercommunicate with each other through a longitudinal groove (passage) 71 which is formed on the outer peripheries of the housing 21 and the fixed scroll 23 so as to extend longitudinally.

The housing 21 is provided with a housing space 21A in which an eccentric axial portion 15A of the driving shaft 15 is rotated, and a radial bearing portion 21B extending downwardly from the center of the lower surface of the housing 21. Furthermore, the housing 21 is provided with a radial bearing hole 28 penetrating between the lower end surface of the radial bearing portion 21B and the bottom surface of the housing space 21A, and the upper end portion of the driving shaft 15 is rotatably fitted and mounted through the radial bearing 30 in the radial bearing hole 28. A suction pipe 31 for leading the refrigerant in the refrigerant circuit to the scroll compression mechanism 11 penetrates through the upper cap 7 of the casing 3 and is air-tightly fixed to the upper cap 7, and a discharge pipe 33 for discharging the refrigerant in the casing 3 to the outside of the casing 3 penetrates through the casing main body 5 and is air-tightly fixed to the casing main body 5. The suction pipe 31 extends in the up-and-down direction in the discharge space 29, and the inner end portion of the suction pipe 31 penetrates through a suction port 32 opened to the fixed scroll 23 of the scroll compression mechanism 11, and intercommunicates with the compression chamber 35. Accordingly, the refrigerant is sucked into the compression chamber 35 through the suction pipe 31.

The driving motor 13 has an annular stator 37 fixed to the inner wall surface of the casing 3, and a rotor 39 which is freely rotatably provided inside the stator 37, the motor 13 is constructed by a DC motor, and the movable scroll 25 of the scroll compression mechanism 11 is connected to the rotor 39 through the driving shaft 15.

The lower space 40 at the lower side of the driving motor 13 is kept to a high-pressure state, and oil is stocked at the inner bottom portion of the lower cap 9 corresponding to the lower end portion of the lower space 40. An oil supply path 41 as a part of a high-pressure oil supply unit is formed in the driving shaft 15, the oil supply path 41 intercommunicates with an oil chamber 43 at the back side of the movable scroll 25. A pickup 45 is connected to the lower end of the driving shaft 15, and the pickup 45 scoops up the oil stocked at the inner bottom portion of the lower cap 9. The scooped oil is passed through the oil supply path 41 of the driving shaft 15 and supplied to the oil chamber 43 at the back side of the movable scroll 25, and supplied from the oil chamber 43 to each sliding portion and the compression chamber 35 of the scroll compression mechanism 11 through an intercommunication path 51 provided to the movable scroll 25.

The fixed scroll 23 comprises a mirror plate 23A and a scroll-like (involute type) lap 23*b* formed on the lower surface of the mirror plate 23A. The movable scroll 25 comprises a mirror plate 25A and a scroll-type (involute type) lap 25B formed on the upper surface of the mirror plate 25A. The lap 23B of the fixed scroll 23 and the lap 25B of the movable scroll 25 are engaged with each other, whereby plural compression chambers 35 are formed by both the laps 23B and 25B between the fixed scroll 23 and the movable scroll 25.

The movable scroll 25 is supported through the Oldham's ring 61 by the fixed scroll 23, and a cylindrical boss portion 25C having a bottom is projected from the center portion of the lower surface of the mirror plate 25A. Furthermore, an eccentric shaft portion 15A is provided to the upper end of the driving shaft 15, and the eccentric shaft portion 15A is rotatably fitted in the boss portion 25C of the movable scroll 25.

Furthermore, a counter weight portion 63 is provided to the driving shaft 15 at the lower side of the radial bearing portion 21B of the housing 21 in order to establish dynamic balance with the movable scroll 25, the eccentric shaft portion 15A, etc. The driving shaft 15 rotates while keeping the weight balance by the counter weight portion 63, whereby the movable scroll 25 does not rotate on its axis, but swirls. the compression chamber 35 is configured so that in connection with the swirling of the movable scroll 25, the refrigerant sucked by the suction pipe 31 is compressed due to contraction of the volume between both the laps 23B and 25B.

A discharge hole 73 is provided at the center portion of the fixed scroll 23, and gas refrigerant discharged from the discharge hole 73 is passed through the discharge valve 75 and discharged to the discharge space 29, and flows out into the high-pressure space 27 at the lower side of the housing 21 through a longitudinal groove 71 formed on the respective outer peripheries of the housing 21 and the fixed scroll 23. This high-pressure refrigerant is discharged to the outside of the casing 3 through the discharge pipe 33 provided to the casing main body 5.

A guide member (gas flow deflecting member) 77 is provided to the lower side of the longitudinal groove 71. The guide member 77 deflects the flow direction of the gas refrigerant (which is discharged from the discharge valve 75 to the discharge space 29, passed through the longitudinal groove 71 and flows downwardly) toward a shielding plate and/or in the horizontal direction along the inner surface of the casing main body 5 (casing 3), and also guides the gas refrigerant through a passage between the shielding plate at the upper side of the coil end 81 of the driving motor 13 and the inner surface of the casing main body 5 (casing 3) and then to the discharge pipe 33.

The driving operation of the scroll type compressor 1 described above will be described.

When the driving motor 13 is driven, the rotor 39 rotates relative to the stator 37, and thus the driving shaft 15 rotates. When the driving shaft 15 rotates, the movable scroll 25 of the scroll compression mechanism 11 does not rotate on its axis, but makes only the swirling motion relative to the fixed scroll 23. Accordingly, low-pressure refrigerant is passed through the suction pipe 31, and sucked from the peripheral edge side of the compression chamber 35 into the compression chamber 35, so that this refrigerant is compressed in connection with volume variation of the compression chamber 35. The compressed refrigerant is increased in pressure, passed from the compression chamber 35 to the discharge valve 75, and discharged to the discharge space 29. Further, the refrigerant is passed through the longitudinal groove 71 formed on the respective outer peripheries of the housing 21 and the fixed scroll 23, and then flows out to the high-pressure space at the lower side of the housing 21. Still further, this high-pressure refrigerant is discharged through the discharge pipe 33 provided to the casing main body 5 to the outside of the casing 3. After the refrigerant discharged to the outside of the casing 3 is circulated in the refrigerant circuit (not shown), the refrigerant is sucked through the suction pipe 31 into the compressor 1 again, and compressed in the compressor. The circulation of the refrigerant as described above is repeated.

The flow of oil will be described. Oil stocked in the inner bottom portion of the lower cap of the casing 3 is scooped up by the pickup 45 provided to the lower end of the driving shaft 15, and this oil is passed through an oil path 41 of the driving shaft 15, supplied to an oil chamber 43 at the back side of the movable scroll 25, and then supplied from the oil chamber 43 through an intercommunication path 51 provided to the movable scroll 25 to each of sliding portions of the scroll compressor mechanism 11 and the compression chamber 35.

Figure 2:
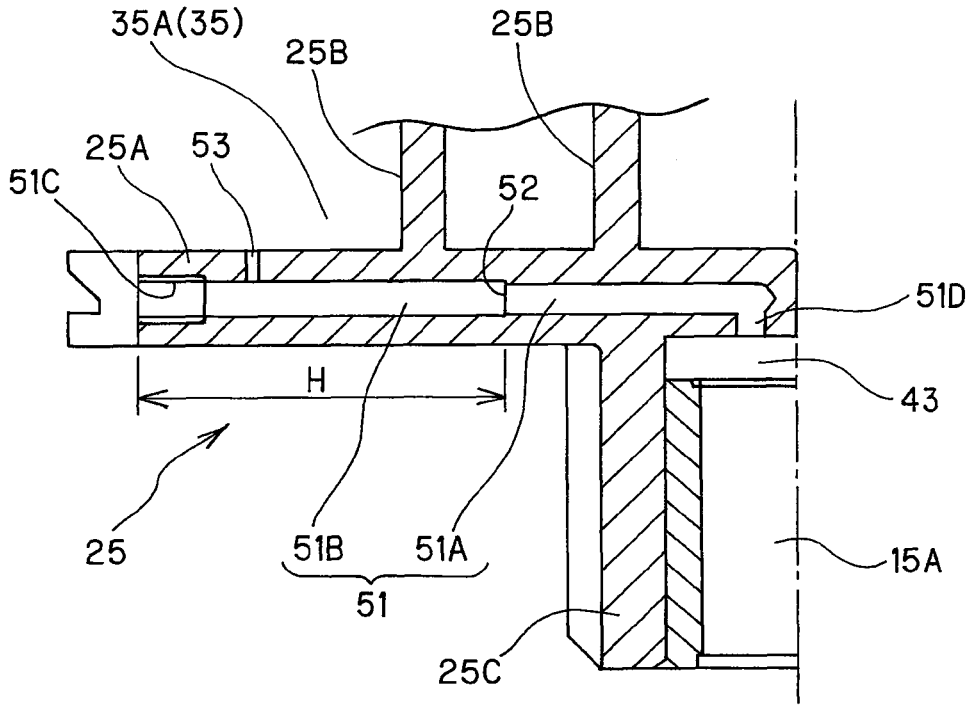
FIG. 2 is an enlarged cross-sectional view showing an intercommunication path designed in the form of a scroll.

FIG. 2 is an enlarged view of the intercommunication path 51 provided to the movable scroll 25.

The mirror plate 25A of the movable scroll 25 is provided with the intercommunication path 51 which is opened outwardly at one end thereof and extends linearly (in a radial direction of the movable scroll 25) inwardly. The intercommunication path 51 is constructed by first forming a lower hole 51A of an intercommunication path whose one end is opened outwardly and conducting reaming processing from one end to a position of a predetermined depth H in the lower hole 51A to form an insertion hole 51B which extends to the predetermined depth H and has a surface roughness lower (i.e., higher smoothness) than the lower hole 51A. Accordingly, a minute step portion (stopper portion) 52 is formed at the rear end of the insertion hole 51B, that is, the boundary between the insertion hole 51B and the lower hole 51A. Furthermore, a female screw hole 51C is formed at an inlet port of the insertion hole 51B. The other end (high-pressure opening) of the intercommunication path 51 is bent in a substantially L-shape, and intercommunicates with the oil chamber (the high-pressure portion in the hermetically-sealed container) 43 at the backside of the movable scroll 25 described above. A low-pressure opening 53 is opened in the inner peripheral surface at the entrance side of the intercommunication path 51. The low-pressure opening 53 intercommunicates with the compression chamber (low-pressure portion 35A) at the outside which is formed between both the laps 23B and 25B of both the scrolls 23 and 25.

Figure 3:
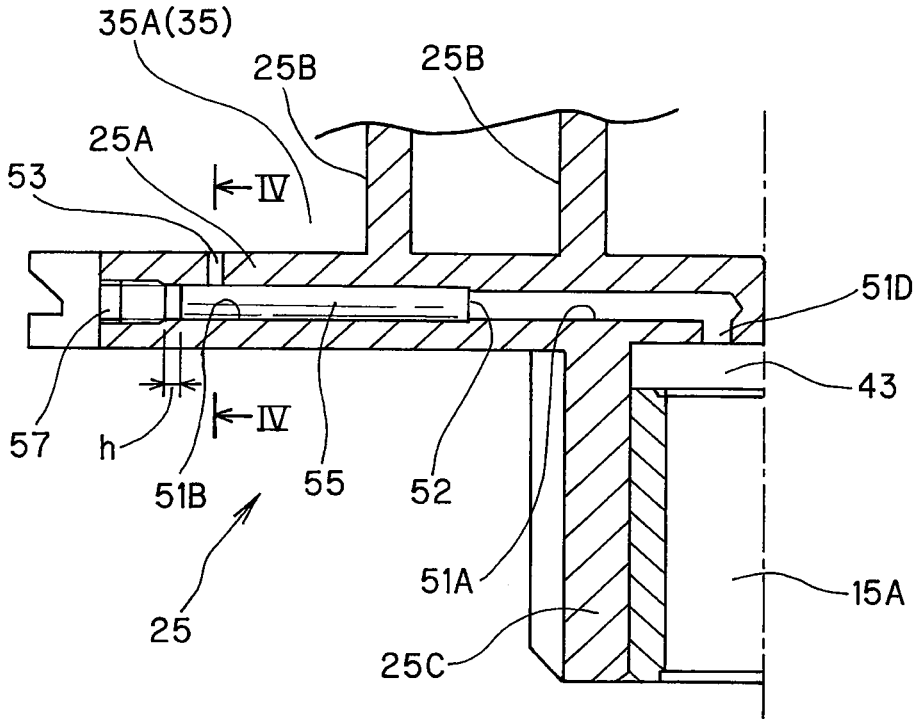
FIG. 3 is an enlarged cross-sectional view showing a state that a pin member is inserted into the intercommunication path.

FIG. 3 shows a state that a flow rate restricting member (pin member) 55 is inserted into the intercommunication path 51.

The pin member 55 is formed by merely cutting a cylindrical pin element, and the pin member 55 is inserted from one end side of the insertion hole 51B into the intercommunication path 51 till it comes into contact with the stopper portion 52 in the intercommunication path 51. A screw member 57 having a hexagon socket is threadedly inserted in the female screw hole 51C provided to one end of the insertion hole 51B so as to be spaced from the pin member 55 at a predetermined interval h so that the pin member 55 is freely movable in the axial direction. This screw member 57 closes one end of the insertion hole 51B. Furthermore, the screw member 57 is fixed by adhesive agent or the like so that it does not come loose.

Figure 4:
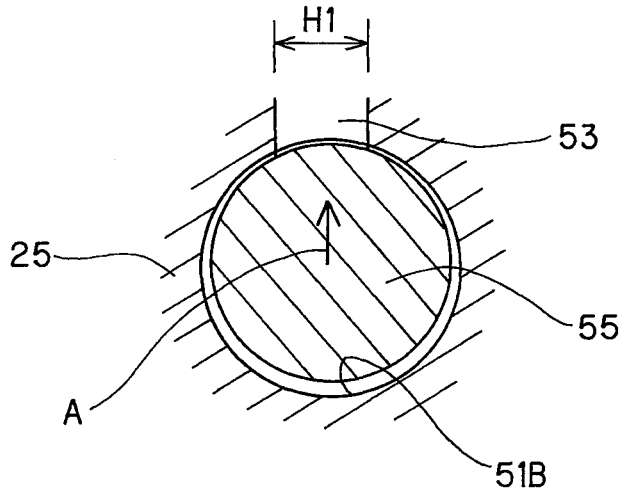
FIG. 4 is a cross-sectional view taken along IV-IV of FIG. 3.

FIG. 4 is a cross-sectional view taken along IV-IV of FIG. 3.

As described above, the pin member 55 is freely movable in the axial direction by the amount corresponding to only the predetermined interval h. When high pressure is applied to the high-pressure opening 51D, the pin member 55 moves in the axial direction in the insertion hole 51B, and the pin member 55 sags (bows) due to the pressure difference between the high-pressure portion and the low-pressure portion. Therefore, the pin member 55 is sucked to the low-pressure opening 53 side opened to the low-pressure portion in the scroll and sags (bows) upwardly as indicated by an arrow A in FIG. 4. Therefore, the pore space of the low-pressure opening 53 is restricted, and the restricted pore space of the low-pressure opening 53 regulates the supply amount (flow rate) of lubricating oil. That is, the supply amount (flow rate) of lubricating oil from the high pressure portion in the hermetically sealed container to the low-pressure portion in the scroll is regulated on the basis of the pressure difference between the high pressure portion and the low pressure portion.

In this construction, the gap between the outer periphery of the pin member 55 and the low-pressure opening 53 opened to the low-pressure portion can be adjusted by properly regulating the size H of the low-pressure opening 53, so that the restriction (regulation) of the supply of lubricating oil can be managed with high precision.

Furthermore, since the pin member 55 is freely movable in the axial direction by the amount corresponding to only the predetermined interval h, fixation of the pin member 55 is prevented, the attitude of the pin member 55 in the insertion hole 51B is properly kept, and the pin member 55 is properly sucked to the low-pressure opening 53. Accordingly, the size of the gap between the outer periphery of the pin member 55 and the low-pressure opening 53 opened to the low pressure portion is kept substantially constant, whereby the restriction of the supply of the lubricating oil can be also managed with high precision.

Still furthermore, according to the above construction, it is unnecessary to subject the pin member 55 to processing. Therefore, when the original shape of the pin member is cylindrical, the pin member can be directly used without modifying the shape. Therefore, it is not dependent on the processing precision, and also the manufacturing cost of the pin member 55 can be reduced.

The stopper portion 52 is formed by the step portion 52 between the lower hole 51A and the insertion hole 51B, and thus the stopper portion 52 can be simply formed.

The reaming processing is conducted from one end of the lower hole 51A till the position of the predetermined depth H of the lower hole 51A, so that the finishing precision of the inner peripheral surface of the insertion hole 51B is enhanced, and the size of the gap between the outer periphery of the pin member 55 and the inner periphery of the intercommunication path 51, and the size of the gap between the outer periphery of the pin member 55 and the low-pressure opening 53 opened to the low-pressure portion can be managed with high precision.

Figure 5B:
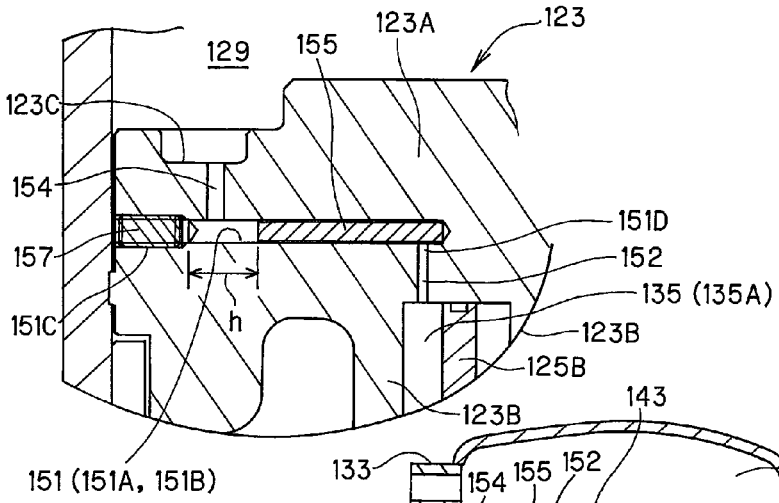
Figure 5A:
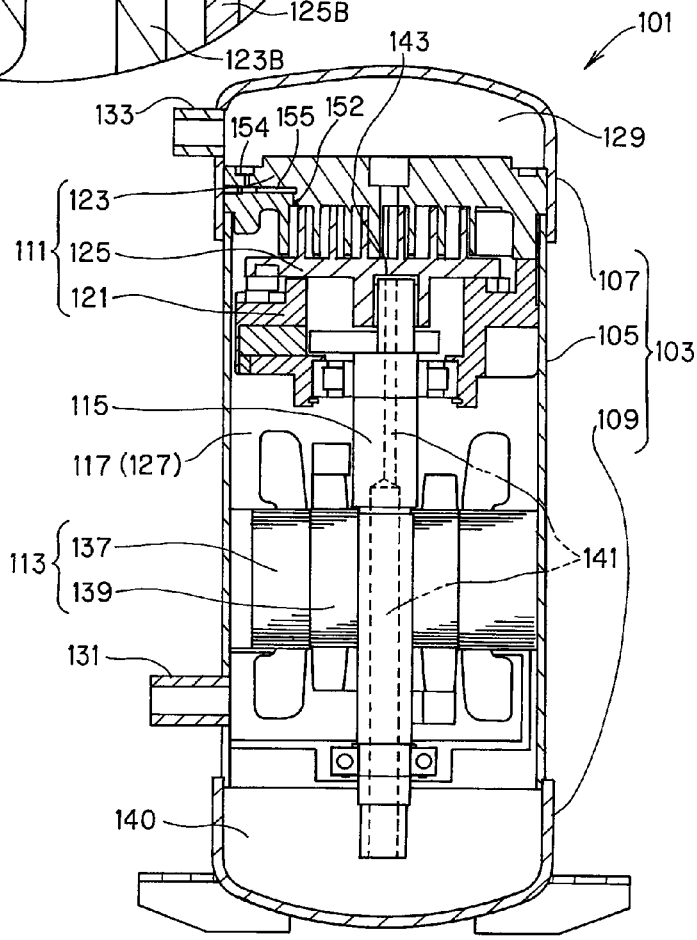

FIGS. 5A and 5B show another embodiment.

In FIG. 5A, reference numeral 101 represents a scroll type compressor which is internally set to low pressure, and this compressor 101 has a longitudinal cylindrical hermetically-sealed dome type casing 103.

The casing 103 is constructed as a pressure container by a casing main body 105 as a cylindrical body portion having an axial line extending in the up-and-down direction, an upper cap 107 which is air-tightly welded to the upper end portion of the casing main body 105, and a lower cap 109 which is air-tightly welded to the lower end portion of the casing main body 5, and the inside thereof is designed as a cavity.

A scroll compression mechanism 111 and a driving motor 113 are accommodated in the casing 103. Reference numeral 115 represents a driving shaft, and a gap space 117 is formed between the scroll compression mechanism 111 and the driving motor 113.

The scroll compression mechanism 111 has a housing 121, a fixed scroll 123 and a movable scroll 125, and the outer peripheral surface of the housing 1 is press-fitted and fixed over the whole surface in the peripheral direction into the casing main body 105, and air-tightly brought into contact with the casing main body 105.

Furthermore, the inside of the casing 103 is compartmented into a low-pressure space at the lower side of the housing 121 and a high-pressure space at the upper side of the housing 21. Furthermore, a suction pipe 131 for leading refrigerant in the refrigerant circuit to the scroll compression mechanism 111 air-tightly penetrates through the lower portion of the casing main body 105 and is fixed to the lower portion of the casing main body 105, and a discharge pipe 133 for discharging refrigerant in the casing 103 to the outside of the casing 103 air-tightly penetrates through the upper cap 107 and is fixed to the upper cap 107.

The driving motor 113 has an annular stator 137 and a rotor 139, and the movable scroll 125 of the scroll compression mechanism 111 is connected to the rotor 139 through the driving shaft 115. The lower space 140 at the lower side of the driving motor 113 is kept to low pressure, and oil is stocked at the inner bottom portion of the lower cap 109 which corresponds to the lower end portion of the lower space 140. An oil supply path 141 as a part of an oil supply unit is formed in the driving shaft axis 115, and the oil supply path 141 intercommunicates with an oil chamber 143 at the back side of the movable scroll 125.

In this embodiment, as shown in FIG. 58, an intercommunication path 151 which is opened to the outside of a mirror plate 123A of the fixed scroll 123 at one end thereof and extends linearly (in a radial direction of the fixed roller) inside the mirror plate 123A is formed in the mirror plate 123A of the fixed scroll 123. The intercommunication path 151 is constructed by first forming a lower hole 151A of the intercommunication path whose one end is opened to the outside, and then conducting reaming processing from one end of the lower hole 151A to form an insertion hole 151B having a low surface roughness (i.e., high smoothness). Furthermore, a female screw hole 151C is threaded in the inlet port of the insertion hole 151B. The other end (low-pressure opening) 151D of the intercommunication path 151 intercommunicates with a compression chamber 135 (low pressure portion 135A) formed between both the laps 123B and 125B of both the scrolls 123 and 125 through a slender hole 152. Furthermore, one end side of the intercommunication path 151 intercommunicates with the high pressure space 129 described above through a slender hole (high pressure opening) 154. The upper end of the slender hole 154 is opened to a recess place 123C as an oil pool formed on the upper surface of the fixed scroll 123.

A flow rate restricting member (pin member) 155 is inserted in the intercommunication path 151, and a screw member 157 is threaded in a female screw hole 151C provided to one end of the insertion hole 151B so as to be spaced from the pin member 155 at a predetermined interval h so that the pin member 155 is freely movable in the axial direction. This screw member 157 closes one end of the insertion hole 151B.

As described above, the pin member 155 is freely movable in the axial direction by the amount corresponding to the predetermined interval h. When high pressure is imposed on the high-pressure space 129, the pin member 155 is pressed by the oil to move to the right side in the axial direction in the insertion hole 151B. At the same time, the pin member 155 sags due to the pressure difference between the high pressure portion and the low pressure portion, and thus the pin member 155 is sucked to the low-pressure opening 151D side opened to the low pressure portion in the scroll by the same phenomenon indicated by the arrow A in FIG. 4, whereby the interval of the low-pressure opening 151D is regulated. This interval restricts the supply amount of the lubricating oil.

In this construction, by properly defining the size of the low-pressure opening 151D, the size of the gap between the outer periphery of the pin member 155 and the low-pressure opening 151D opened to the low pressure portion is adjusted, so that the restriction of the supply of the lubricating oil can be managed with high precision.

Furthermore, since the pin member 155 is freely movable in the axial direction by only the predetermined interval h. Therefore, fixation of the pin member 155 is avoided, and the attitude of the pin member 15 in the insertion hole 151B is properly kept, and the pin member 155 is properly sucked to the low-pressure opening 151D. Accordingly, the size of the gap between the outer periphery of the pin member 155 and the low-pressure opening 151D opened to the low pressure portion is kept substantially constant, whereby restriction (regulation) of the supply of the lubricating oil can be also managed with high precision.

Still furthermore, according to this construction, it is unnecessary to subject the pin member 155 to processing, and when the original shape of the pin member is cylindrical, the pin member can be directly used without modifying the shape. Therefore, it is not dependent on the processing precision, and also the manufacturing cost of the pin member 155 can be reduced.

What is claimed is:

1. A scroll type compressor comprising:

a fixed scroll;

a movable scroll engaged with the fixed scroll; and a hermetically sealed container in which the fixed scroll and the movable scroll are mounted, wherein:

one scroll of the fixed scroll and the movable scroll includes:

an intercommunication path that is opened to the outside of the one scroll at one end thereof, extends substantially in a radial direction of the one scroll and has a high-pressure opening intercommunicating with a high-pressure portion of the hermetically sealed container and a low-pressure opening intercommunicating with a low-pressure portion in the one scroll, oil being supplied from the high-pressure opening through an inside of the intercommunication path to the low-pressure opening;

a pin member that is configured to be slightly smaller in diameter than the intercommunication path and disposed in the intercommunication path so as to be movable in the radial direction of the one scroll by a predetermined distance; and a screw member that is provided at one end of the intercommunication path so as to close the one end of the intercommunication path, is provided as a separate component from the pin member and is disposed so as to be spaced from the pin member, wherein:

the pin member is configured so as to move in the radial direction apart from a side of the screw member to a side of the low-pressure opening due to a pressure difference between the high-pressure portion and the low-pressure portion, the intercommunication path has a first path opened to the outside of the one scroll at one end thereof and a second path, a step portion is disposed at an interface of the first and second paths serving as a stopper, the pin member is inserted in the first path, a diameter of the first path is larger than a diameter of the pin member and a diameter of the second path, and the diameter of the pin member is larger than the diameter of the second path.

2. The scroll type compressor according to claim 1, wherein the intercommunication path has a linearly extending portion in the movable scroll.

3. The scroll type compressor according to claim 1, wherein the pin member is sucked to the low-pressure opening opened to the low pressure portion due to a pressure difference between the high pressure portion and the low pressure portion to thereby restrict a gap between an outer periphery of the pin member and the low-pressure opening opened to the low-pressure portion.

4. The scroll type compressor according to claim 1, further comprising a stopper that is provided at a predetermined position in the intercommunication path and regulates movement of the pin member in the radial direction of the one scroll so that the pin member is movable between the screw member and the stopper.

* * * * *